United States Patent [19]

East

[11] 4,073,323

[45] Feb. 14, 1978

[54] TUBING DEFLECTOR

[76] Inventor: Eldon Dwayne East, 4522 Casa Oro Drive, Yorba Linda, Calif. 92686

[21] Appl. No.: 701,225

[22] Filed: June 30, 1976

[51] Int. Cl.[2] ..... B65B 3/00

[52] U.S. Cl. ..... 141/326; 141/367

[58] Field of Search ..... 138/37–46, 138/111; 403/13, 14; 285/DIG. 15, 25, 28; 141/285, 286, 325, 326, 327, 367

[56] References Cited

FOREIGN PATENT DOCUMENTS 778,661 2/1968 Canada ..... 285/DIG. 15

*Primary Examiner*—Houston S. Bell

*Attorney, Agent, or Firm*—Edward E. Roberts

[57] ABSTRACT

This invention relates to a deflector which is specifically utilizable with a receptacle having a plurality of openings for receiving one or more interconnecting tubings. The deflector includes a plate-like member which is sufficiently large to effectively block a first opening in the receptacle. The plate-like member is biased to a first position to block the first opening in the receptacle. An engagement or abutment member is arranged to project into a second opening in the receptacle to engage or abut the tube which is deflected by said plate member into the second opening in the receptacle. When the abutment member is abutted by a tube, the abutment member rotates around a given axis. The abutment member is appropriately connected to the plate-like member to cause this latter member to also rotate about the given axis such that the plate-like member is removed from blocking relationship relative to said first opening in the receptacle. Thus, a second tube member can be inserted into the now unblocked first opening in the receptacle.

9 Claims, 6 Drawing Figures

FIG. 4.
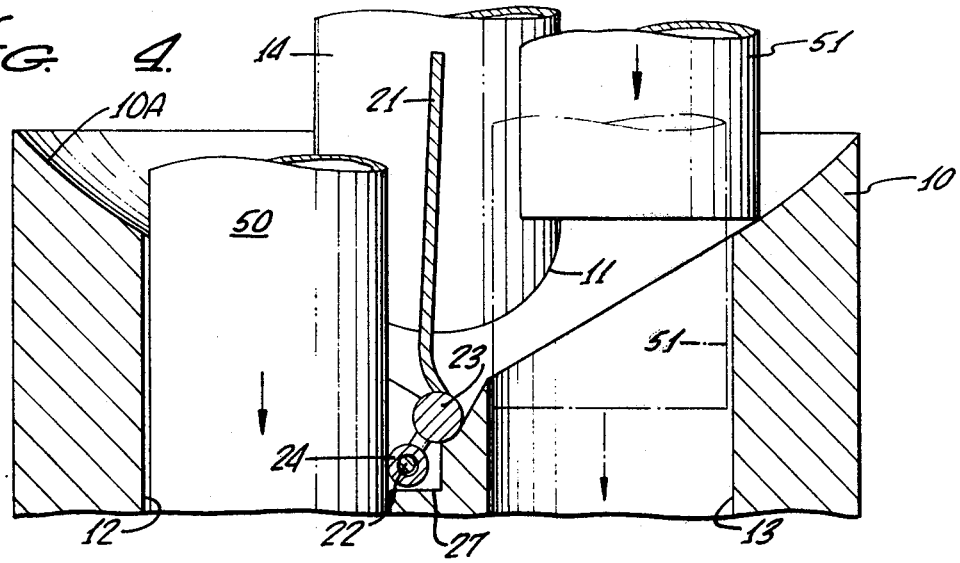
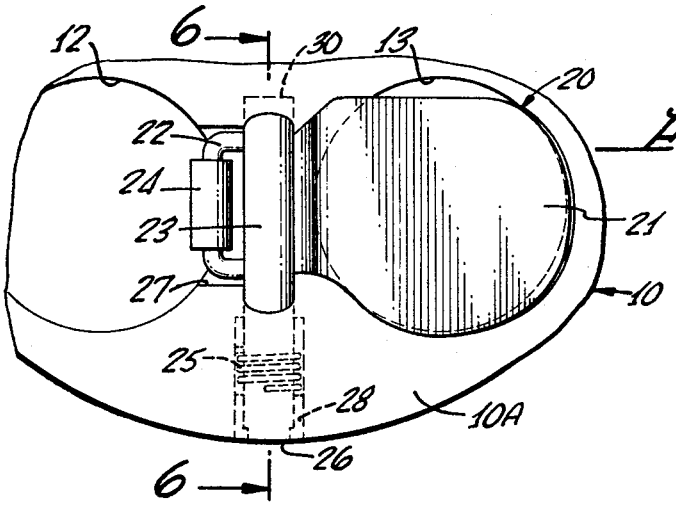
FIG. 5.
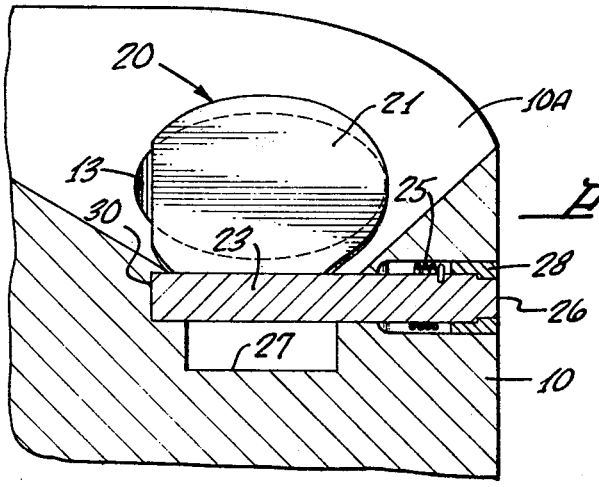
FIG. 6.

TUBING DEFLECTOR

BACKGROUND OF THE INVENTION

1. Field of the Invention

This invention is directed to mechanical interconnecting elements for various plumbing-like arrangements, in general, and is directed to an improvement for "down-hole" equipment used in petroleum recovery techniques, in particular.

2. Description of the Prior Art

In the oil field industry, in particular, it is frequently necessary to make interconnections of a plurality of tube-like members called "strings" with other equipment which is already placed down-hole. Inasmuch as many down-hole operations are conducted at extensive distances below the surface, the strings become extremely long and must be interconnected from a remote distance. As a result, it is essential to facilitate the interconnection arrangement. One such method is the so-called conical receptacle wherein a down-hole receptacle has a conical upper surface with openings therein, which opening may have different diameters. In this manner, the strings may be "stabbed" into the receptacle by the expedient of attempting a "stab-in" of the largest diameter tubing first. In this method, the larger tubing or string will not enter the smaller hole in the receptacle and will preferably seat itself in the appropriate hole. However, sometimes it is desirable (or necessary) to utilize a receptacle having two or more holes which are of the same or substantially the same diameter for effecting other oil field production techniques. In these cases, as well as others, it is frequently difficult to stab-in the appropriate tubing into the appropriate hole in the receptacle. If the wrong tube is inserted into a hole in the receptacle, the tubing must be removed and reseated in the proper hole. This operation may be time consuming and, thus, expensive due to down time of the production rig or the like. To date, there is no known solution to the problem other than the utilization of the conical receptacle device and the "trial and error" stabbing technique.

SUMMARY OF THE INVENTION

This invention relates to a means for deflecting tubes into the appropriate holes in a suitable receptacle. Preferably, the receptacle is of the type which has a conical upper surface which will tend to direct tubing toward apertures in the receptacle. The invention comprises a rotatable flap or plate-like member which is mounted on a pivot member which is disposed at the conical surface of the receptacle. The pivot member is disposed between openings in the receptacle which are intended to receive remotely applied tubes. The plate-like member is biased to assume a first position wherein one opening in the receptacle is blocked. When a tube is applied, it will be deflected by the plate-like member into an adjacent opening which will be the appropriate hole for the deflected tube. The tube, when it enters the appropriate hole, will abut or engage an abutment member which will cause the deflector to rotate wherein the plate-like member is displaced from the original position wherein the previously blocked opening is now free to receive a further tube. The plate-like member will remain essentially in the rotated and unblocked position so long as the first tube remains in the appropriate hole. When the first tube is removed from the hole the deflector is free to return to the original position in response to the bias means.

BRIEF DESCRIPTION OF THE DRAWINGS

FIG. 4 is a cross-sectional view similar to the view of FIG. 3 but with the deflector in the unblocked position.

FIG. 5 is a top view of the portion of a receptacle with the deflector of the instant invention in the blocking position.

FIG. 6 is a partial side view of the deflector in the blocking position taken along the lines 6—6 of FIG. 5.

DETAILED DESCRIPTION OF A PREFERRED EMBODIMENT

Figure 1:
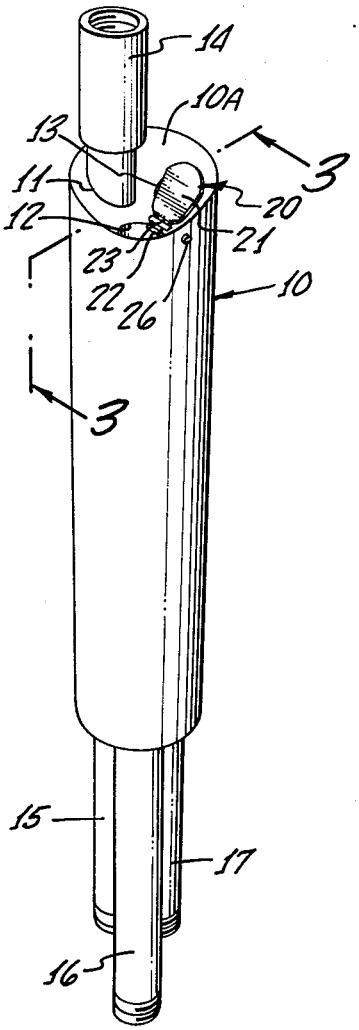
FIG. 1 is a perspective view of suitable receptacle for receiving tubing including the deflector of the instant invention.

Referring now to FIG. 1, there is shown a perspective view of a suitable receptacle 10 many of which are known in the art. The particular receptacle 10 which is shown includes conical surface 10A into which various tubes or tubing strings are inserted. Receptacle 10 is shown as including therein holes 11, 12 and 13 (partially obscured) for receiving tubing which is, or will be, stabbed-in. Tubing 14 represents a suitable main string which is already in place in receptacle 10. Typically, tubing 14 is used to lower receptacle 10 to the desired well depth. Tubes 15, 16 and 17 project from the bottom of receptacle 10 and interact with holes 11, 12 and 13 as well as the tubings which are inserted into the holes. Deflector 20, which is described in greater detail subsequently, includes a plate-like member 21 which is pivotally mounted between holes 12 and 13. As shown in FIG. 1, deflector 20 is mounted in the deflecting or blocking position.

Figure 2:
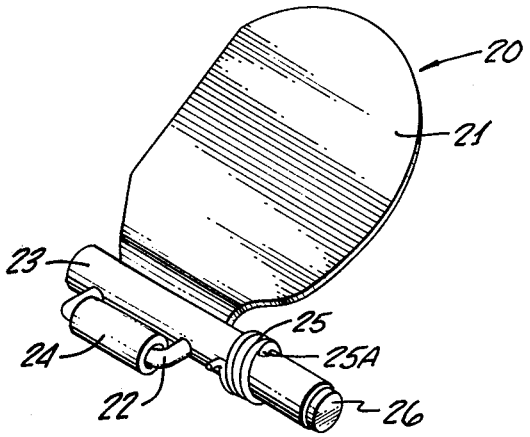
FIG. 2 is a perspective view of the deflector which forms the instant invention.

Referring concurrently now to FIGS. 1 and 2, deflector 20 includes plate-like member 21 which is utilized to block a hole or aperture, e.g. hole 13, in receptacle 10. Abutment member 22 is mounted at pivot member 23 along with plate-member 21. Plate member 21, abutment member 22 and pivot member 23 can be integrally formed. However, any suitable interconnection of these members is contemplated. Roller 24, which can be fabricated of any suitable material such as neoprene or the like is rotatably mounted on abutment member 22 to permit a rolling action of the tubing stab-in or stinger which passes thereby after engagement therewith. Roller 24 may be omitted but it reduces friction between the abutment member and the tubing during both insertion and removal procedures. Coil spring 25 is wrapped around pivot member 23 and anchored thereto at end 25A. The other end of coil spring 25 is placed in engagement with a portion of receptacle 10 in a suitable manner. Spring 25 is operative to provide a spring-loaded bias to deflector 20 so that plate member 21 initially assumes a predetermined position. In the embodiment shown, plate 21 blocks a predetermined hole such as hole 13 in FIG. 1. Adjustment member 26 is suitably mounted relative to pivot member 23. Adjustment member 26 may be a threaded member which can be selectively inserted and threadedly engaged with pivot member 23 in order to mount deflector 20 in the receptacle.

Figure 3:
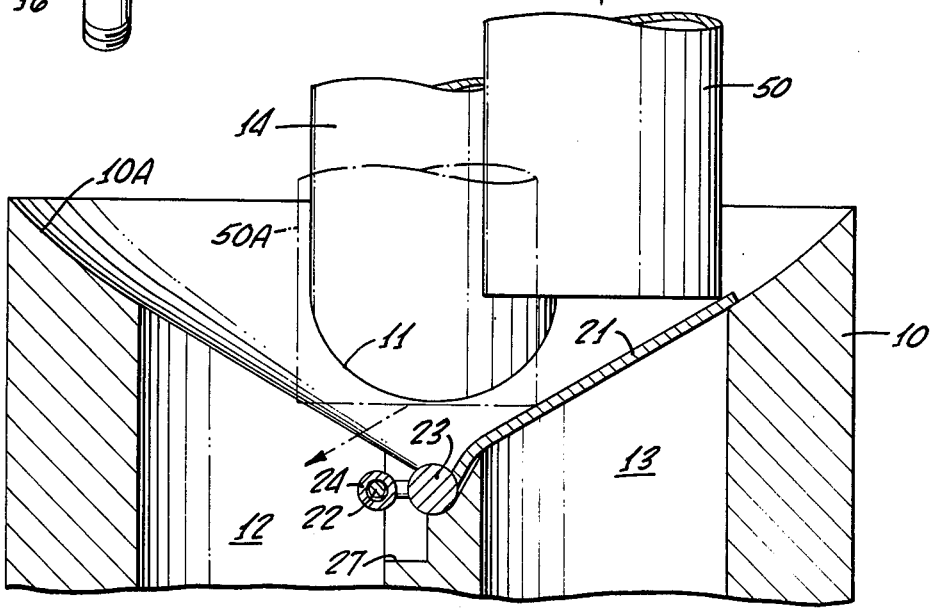
FIG. 3 is a cross-sectional view of a portion of the receptacle and the deflector taken along the lines 3—3 of FIG. 1.

Concurrent reference is now made to FIGS. 3 and 4. In each of these figures, receptacle 10 includes conical surface 10A. The holes or openings 11, 12 and 13 are found in the conical surface. In the illustration given, tubing 14 has already been inserted into opening 11.

As shown in FIG. 3, the initial condition is such that plate member 21 blocks hole 13. That is, pivot member 23 is mounted in receptacle 10 between holes 12 and 13 and bias member (for example spring 25) forces plate member 21 to the position shown. It is clear that abutment member 22 and roller 24 extend into opening 12. It should be noted that a small recess 27 is provided in opening 12 adjacent to pivot member 23 to receive abutment member 22 and roller 24.

The insertion of tubing 50 or 51 from a remote location is difficult to control. That is, tubing 50 or 51 (frequently called side strings) have stab-ins or stingers on the bottom-ends thereof that are stabbed into openings 12 or 13, respectively after the tubing is lowered to the depth of receptacle 10. This depth can be on the order of a mile or more. Although the depth is not limitative of this invention, it is possible that tube 50 can approach receptacle 10 from an incorrect position. Initially, conical surface 10A of receptacle 10 will tend to direct tube 50 toward the correct location. Moreover, with deflector plate member 21 in the blocking position as shown in FIG. 3, tube 50, which is inserted in the direction suggested by the arrow, will tend to slide along deflector plate member 21 toward opening 12 as suggested by the dashed outline 50A. As tube 50 slides toward opening 12, tube 50 becomes substantially seated therein and additional vertical pressure (see arrow in FIG. 4) will force tube 50 into opening 12.

Referring specifically to FIG. 4, it is seen that, as tube 50 is inserted into opening 12, the edge and side thereof abut abutment member 22 and roller 24 to cause these members to rotate around pivot member 23. As pivot member 23 is forced to rotate, plate member 21 also rotates out of the blocking position and into the substantially vertical position shown in FIG. 4. In this condition, plate member 21 is essentially parallel to the side of tube 50. Tube 51 is now inserted and is directed by surface 10A of receptacle 10 as noted above. In this instance, tube 51 is properly seated in opening 13. In this operation, plate 21 may also have the effect of guiding tube 51 into opening 13 by preventing it from moving into contact with tube 50.

Concurrent reference is now made to FIGS. 5 and 6. FIG. 5 is a top view of portions of receptacle 10 including deflector 20 while FIG. 6 is a cross-sectional view of the structure shown in FIG. 6 taken along the lines 6—6. Again, plate member 21 is shown in the blocking position relative to hole 13. Likewise, abutment member 22 and roller 24 extend into opening 13. Recess 27 is provided to receive abutment member 22 and roller 24 when they are rotated.

A suitable slot or hole 30 (shown in dashed outline) is provided to receive pivot member 23 so that the deflector may be inserted into the receptacle. In a preferred embodiment, slot 30 has a slightly enlarged end bore for receiving spring 25. In addition, as suggested in FIGS. 2, 5 and 6, pivot member 23 has a reduced end-portion 26 which may be threaded or otherwise treated to receive threaded cap 28 or the like. Thus, the deflector may be installed in the receptacle 10 by inserting the pivot member 23 of deflector 20 into bore 30 and clamping the device in position by means of threaded cap 28 which can be properly secured in any suitable fashion. Thus, there has been shown and described a new and improved device for directing tubing in a remote location. The invention has been described in terms of down-hole apparatus for oil field production equipment. However, the invention is considered to have broader application any may be used in selective direction of remotely applied, semi-rigid materials which must be seated in an appropriate location. In addition, in the preferred embodiment, the bias member has been shown as a coil spring. However, other bias members or arrangements are contemplated. For example, the bias member could be provided in the form of a magnet of a magnetic material at plate 21. In addition, the specific shape or configuration of plate 21 can be altered as well as other similar modifications to the deflector. However, any such modifications are intended to be included within the purview of the instant description as well. The preferred embodiment is intended to teach the thrust of the invention and is not intended to be limitative thereof. The scope of the invention is limited only by the scope of the claims appended hereto.

Having thus described the preferred embodiment, what is claimed is:

1. A deflector utilizable with a receptacle having a plurality of openings therein for receiving elements in selected ones of said openings as a function of the position of said deflector;
said deflector comprising;
a pivot member;
a plate-like member joined to said pivot member;
an abutment member joined to said pivot member;
said pivot member mounted in said receptacle between said openings such that said plate-like member covers one of said openings when in an initial position and said abutment member extends into a further opening; and
bias means for establishing said initial position of said plate-like member.

2. The combination recited in claim 1 where:
said bias means comprises coil spring means wrapped around said pivot member.

3. The combination recited in claim 1 wherein:
said pivot member includes a cap member for securing said pivot member in an aperture in said receptacle;
said aperture arrayed between said openings in said receptacle and transversal to the long dimension of said openings.

4. The combination recited in claim 1 including:
roller means coupled to said abutment means.

5. The combination recited in claim 1 wherein:
said receptacle means has an inwardly formed conical end surface; and
said pivot member is disposed at the top-end of said conical surface.

6. The combination recited in claim 1 wherein:
said pivot member, said plate-like member, and said abutment member are integrally joined.

7. The combination recited in claim 1 wherein:
first insertion means is inserted into said further opening and moves said abutment means such that it rotates about said pivot member whereby said plate-like member is removed from said initial position such that said one opening is uncovered.

8. The combination recited in claim 1 where:
said plate-like member is formed of magnetic material to provide a biasing action for establishing the initial position thereof.

9. The combination recited in claim 1 wherein said pivot member, said plate-like member and said abutment member are integrally formed.

* * * * *